US005421468A

United States Patent [19]

Wright

[11] Patent Number: 5,421,468

[45] Date of Patent: Jun. 6, 1995

[54] DOCKSIDE CONTAINER HANDLING CRANE WITH HIGH SPEED HOIST SYSTEM

[75] Inventor: Larry A. Wright, Point Richmond, Calif.

[73] Assignee: Conquip International, Inc., Roxboro, N.C.

[21] Appl. No.: 71,685

[22] Filed: Jun. 3, 1993

[51] Int. Cl.[6] ..... B66C 11/20

[52] U.S. Cl. ..... 212/323; 212/250; 212/325; 294/814

[58] Field of Search ..... 294/81.4; 212/191, 214, 212/215, 216, 217, 250, 219

[56] References Cited

U.S. PATENT DOCUMENTS

| | | | |
|---|---|---|---|
| 451,269 | 4/1891 | Dixon | 212/214 |
| 922,208 | 5/1909 | Suess | 212/217 |
| 3,945,503 | 3/1976 | Cooper | 212/219 |
| 4,883,388 | 11/1989 | Cherbonnier | 212/191 |
| 5,018,631 | 5/1991 | Reimer | 212/250 |
| 5,114,026 | 5/1992 | Van Ketel Hendrik | 212/191 |

FOREIGN PATENT DOCUMENTS

| | | | |
|---|---|---|---|
| 44254 | 12/1934 | France | 212/250 |

*Primary Examiner*—Michael S. Huppert
*Assistant Examiner*—Thomas J. Brahar
*Attorney, Agent, or Firm*—Richard E. Jenkins

[57] ABSTRACT

A high speed cable hoist system for conventional dockside container handling cranes of the type comprising a frame and a movable boom extending laterally therefrom. The high speed cable hoist includes a hoist cable speed enhancing system which comprises a frame having a stationary sheave set positioned at the bottom thereof and a vertically movable sheave head positioned above the stationary sheave set and adapted for vertical movement within the frame. Each of a plurality of hoist cables from the conventional hoist drums extend between and wrap around two or more sheaves in each of the sheave set and sheave head, respectively, and terminate. The sheave head may be selectively actuated by suitable actuating means in order that the speed of extension or retraction of the plurality of cables by the hoist drum may be increased by motivating the sheave head either toward or away, respectively, from the stationary sheave set.

7 Claims, 5 Drawing Sheets

FIG. 3

DOCKSIDE CONTAINER HANDLING CRANE WITH HIGH SPEED HOIST SYSTEM

TECHNICAL FIELD

The present invention relates to cranes and more particularly to a dockside container handling crane having a high speed hoist system for improved container lifting capability.

RELATED ART

The field of the art includes many of the older generation dockside container handling cranes (such as the Sea/Land late 1960 and 1970 series cranes) which have been raised in height to accommodate larger container loads and the like, but the lifting speeds of these cranes have not been increased to this date. Thus, the duty cycle time to handle a container load has been increased because of the increased hoist heights, and consequently there are hundreds of these older and slower dockside container cranes which could benefit from increased hoist speed to cut down the cycle time and improve their respective productivity.

For example, if the hoist speed of the older dockside cranes could be increased from 100 FPM (feet per minute) to 150 FPM, it would be possible to significantly improve productivity of pick up to four to five containers per hour.

The conventional hoisting system used in the dockside container handling cranes provides for hoist cables which are wound around one or more hoist drums and the cables then led through the trolley and headblock sheaves and tied-off (or terminated) at the tip of the pivotable boom of the crane. With this conventional hoist system, the hoist drums must reel in the hoist cables at a linear speed of 200 FPM (feet per minute) in order to achieve a 100 FPM vertical hoist speed.

There has been a long-felt need for a high speed hoist system which could be retrofitted to the older generation dockside container cranes in order to increase hoist speeds without the necessity for purchasing expensive higher speed new dockside container handling cranes or the expense of replacing the existing hoist drives with new hoist machinery, motor, brake or controls. Applicant has met this long-felt need with the high speed hoist system of the present invention which can be economically and rapidly retrofitted to existing dockside container handling cranes.

DISCLOSURE OF THE INVENTION

In accordance with the present invention, applicant provides an improved cable hoist system for a conventional dockside container handling crane of the type comprising a frame and a movable boom extending generally laterally therefrom and further comprising a cable hoist system having a hoist drum with a plurality of cables wound therearound and operatively engaging a corresponding plurality of headblock sheaves adapted to be raised and lowered to vertically adjust a container-engaging spreader apparatus or the like.

The improvement comprises a hoist cable speed enhancing system positioned between said headblock sheaves and the terminal ends of said hoist cables. The hoist cable speed enhancing system comprises a frame and a stationary sheave set supported by the frame which includes a plurality of sheaves. A sheave head including a plurality of sheaves is supported by the frame and adapted for vertical movement within the frame toward and away from the stationary sheave set. Means for selectively actuating the sheave head are provided so as to motivate the sheave head toward or away from the stationary sheave set, and each of the plurality of cables from the hoist drum extends between and wraps around two or more sheaves in each of the sheave set and sheave head, respectively, and terminates. In this fashion, the speed of extension or retraction of the plurality of hoist cables by said hoist drum is increased by said actuating means by selectively motivating the sheave head either toward or away, respectively, from the stationary sheave set.

It is therefore the object of the present invention to provide an improved cable hoist system for a dockside container handling crane.

It is another object of the present invention to provide a high speed cable hoist system for a dockside container handling crane which can be relatively easily retrofitted to the existing crane.

It is still another object of the present invention to improve the productivity of older generation dockside container handling cranes by enhancing the cable hoist speed with a novel high speed hoist system.

It is still another object of the present invention to provide a high speed hoist system in order to significantly increase the hoist speed of older generation dockside container handling cranes such as the Sea/-Land late 1960 and 1970 series cranes at a reasonable cost and with a minimum of downtime to the crane being retrofitted with the high speed cable hoist system.

It is still another object of the present invention to provide increased hoist height and thereby permit increasing of the overall crane height without the necessity of modifying existing hoist machinery.

Some of the objects of the invention having been stated, other objects will become evident as the description proceeds, when taken in connection with the accompanying drawings described hereinbelow.

BEST MODE FOR CARRYING OUT THE INVENTION

Figure 1:
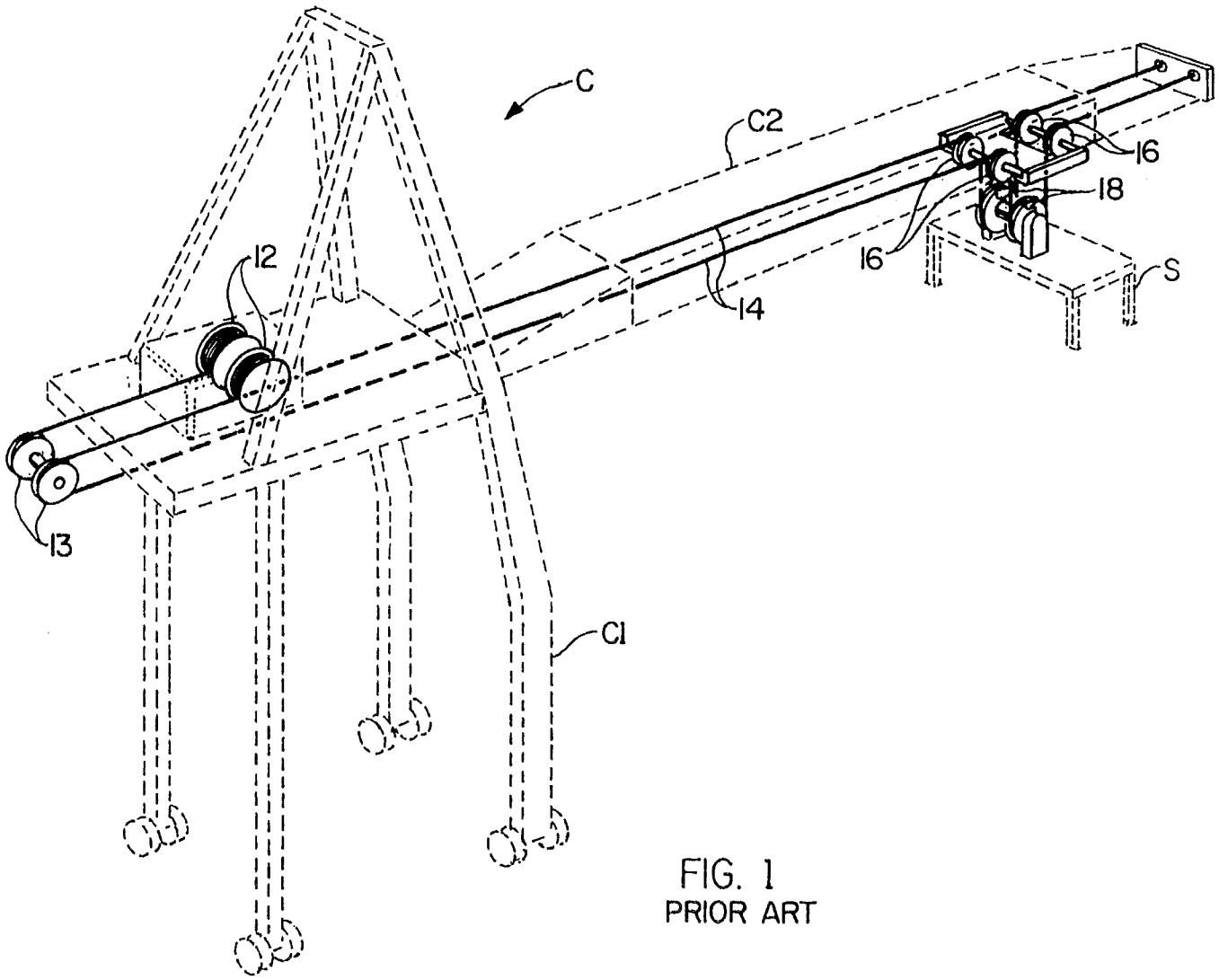
FIG. 1 PRIOR ART
FIG. 1 is a schematic view (with the dockside container handling crane shown in phantom lines) of the conventional hoist system wherein the hoist cables are wound around the hoist drums and led through the trolley and headblock sheaves and then terminated at the boom tip.

Referring now to the drawings, FIG. 1 shows a conventional dockside container crane C shown in phantom lines except for the hoist system. Crane C can be seen to comprise upstanding frame portion Cl and pivotably movable boom arm C2.

The conventional hoist cable hoist system utilized by dockside container crane C includes conventional hoist drums 12 having a plurality of hoist cables 14 (two for purposes of illustration in FIGS. 1 and 2, but conventionally 4, 6 or 8 hoist cables would be utilized) wrapped therearound and extending from the hoist drums around turning sheaves 13 and through trolley pulleys 16 and headblock sheaves 18 to then terminate in a conventional manner at the boom tip. As will be appreciated by one of ordinary skill in the art, a spreader S or other similar type of container engaging device may be lowered and raised by withdrawing hoist cables 14 from hoist drums 12 or retracting hoist cables 14 onto hoist drums 12, respectively. For example, to obtain 100 FPM (feet per minute) hoist speed for vertical movement of spreader S, hoist drums 12 must be driven so as to reel in hoist cables 14 at 200 FPM. This limitation in the hoist speed of the conventional dockside container crane C shown in FIG. 1 has been overcome by applicant's novel high speed cable hoist system which is shown in FIG. 2 as having been retrofitted to otherwise conventional crane C.

Figure 2:
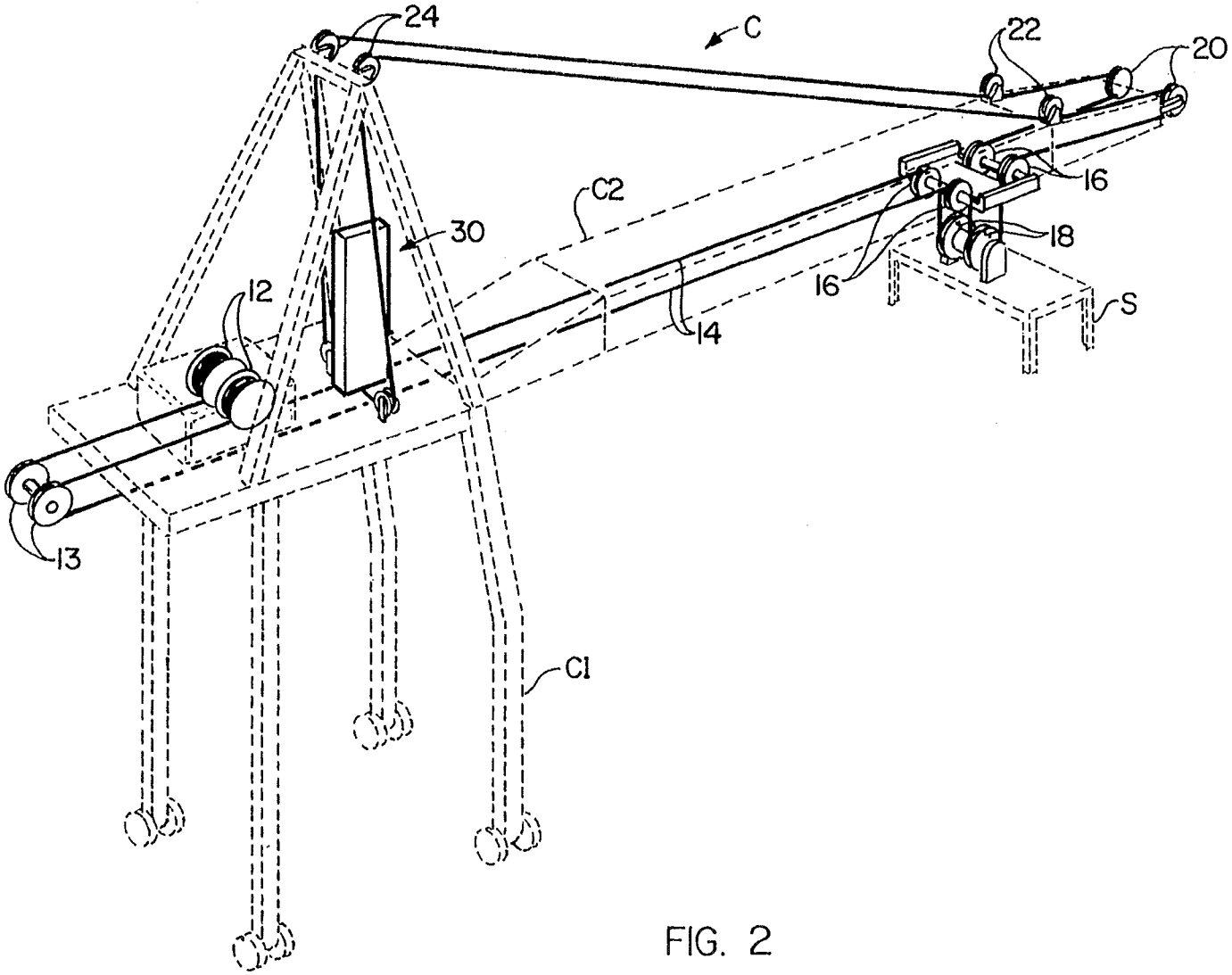
FIG. 2 is a schematic view (with the dockside container handling crane shown in phantom lines) of the novel high speed cable hoist system of the invention wherein the cables are wound around the hoist drums and led through the trolley and headblock sheaves and led back from the boom tip to the multiple sheave linear speed enhancer mechanism of the novel high speed cable hoist system of the invention.

Referring now to FIG. 2, the novel hoist system can be seen to comprise conventional hoist drums 12 with hoist cables 14 wrapped therearound and extending therefrom around turning sheaves 13 and through trolley pulleys 16 system shown in FIG. 1. However, instead of terminating hoist cables 14 at the outer end of boom C2, hoist cables 14 extend to the end of boom C2 and around pulleys 20 through pulleys 22 and 24 to a hydraulically-driven multiple sheave mechanism, generally designated 30, which acts to selectively extend or retract hoist cables 14 (which terminate therein) so as to enhance the speed of extension or retraction provided by hoist drums 12. Although hydraulically-driven multiple sheave mechanism 30 (which is shown in detail in FIGS. 3–6 of the drawings) can be designed to provide different hoist cable speed enhancements, it is contemplated that most suitably the speed of hoist cables 14 can be increased from about 100 FPM to between about 150 and 200 FPM by the high speed cable hoist system of the invention.

Figure 3:
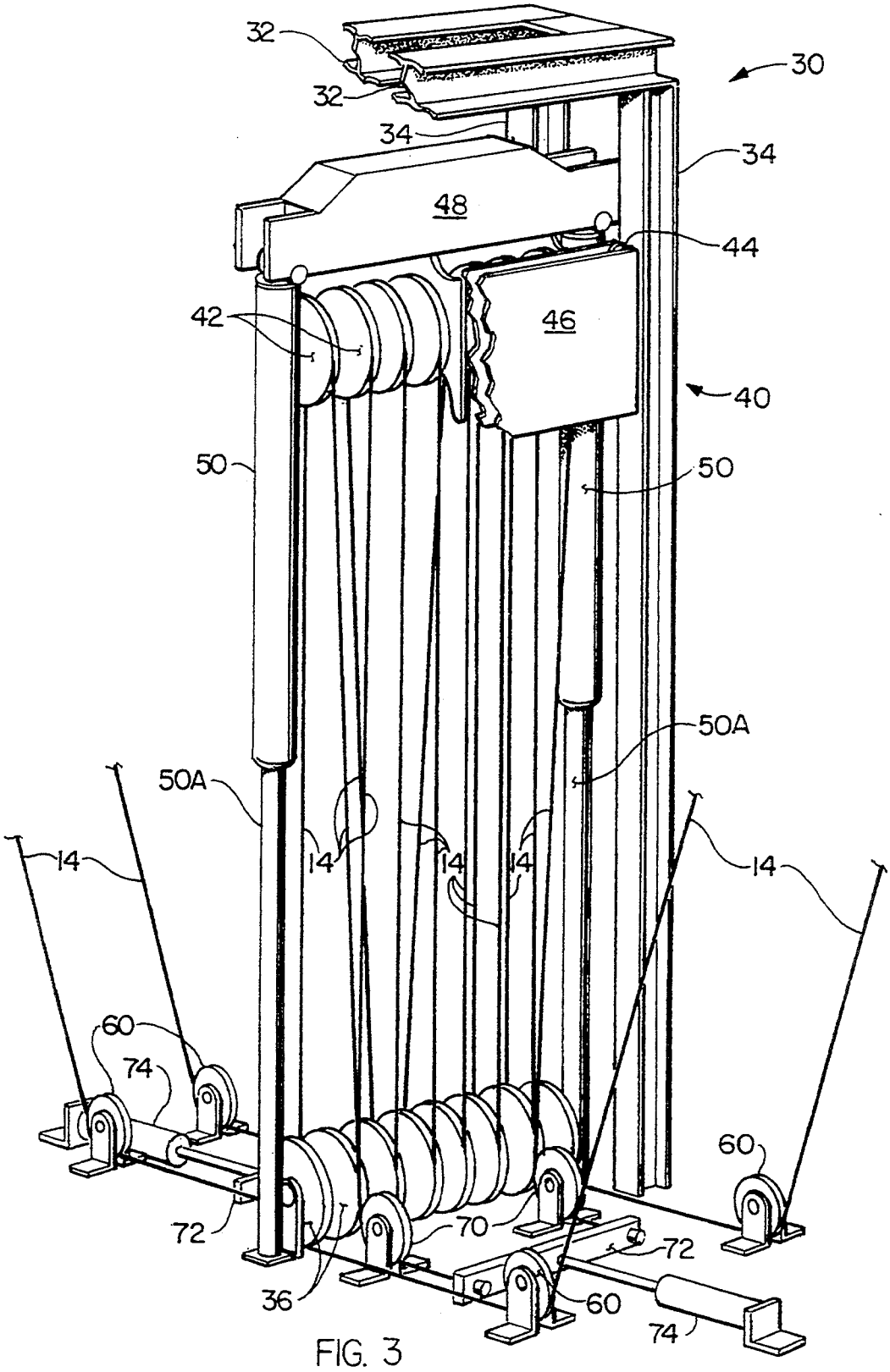
FIG. 3 is a perspective view, the parts broken away for clarity, of the multiple sheave linear speed enhancer mechanism of the high speed cable hoist system of the invention.
Figure 4:
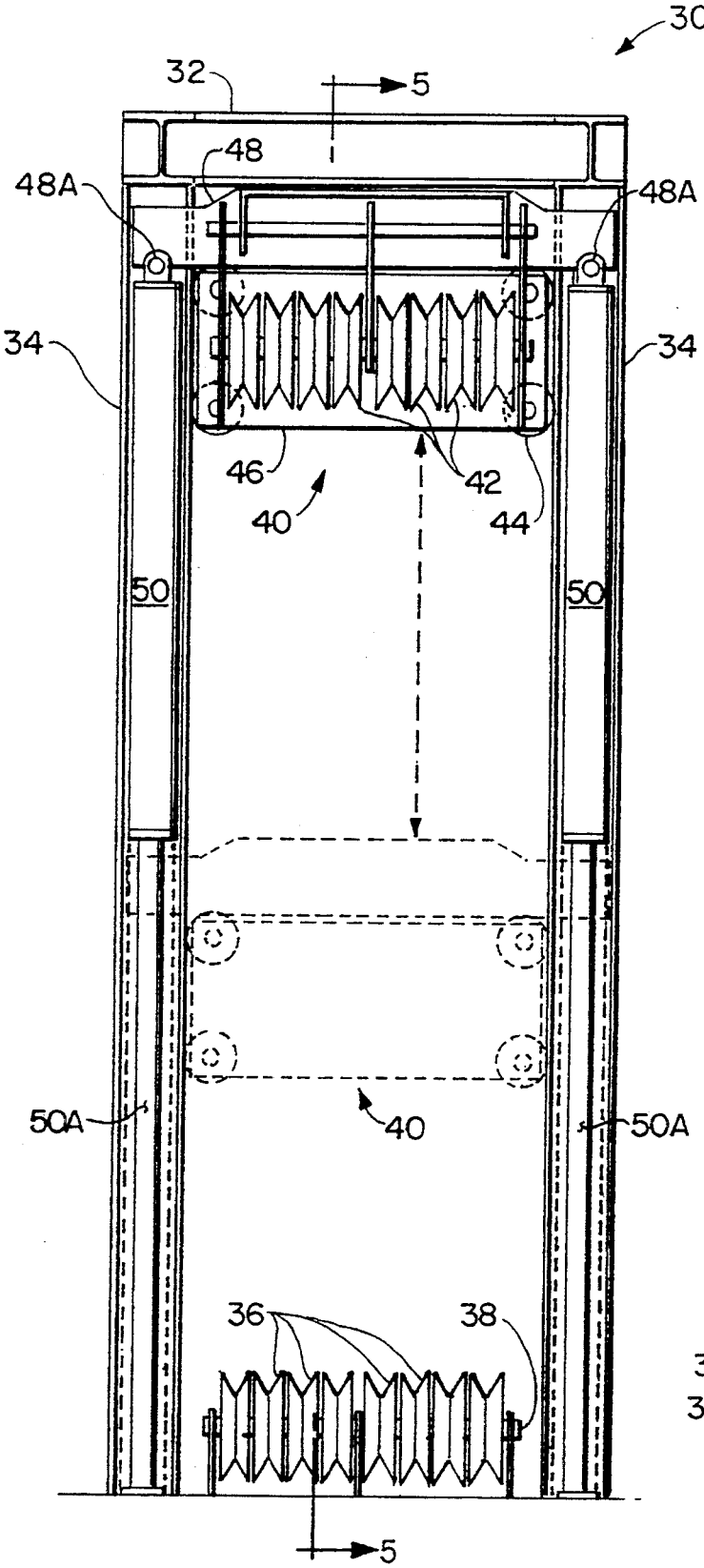
FIG. 4 is a vertical cross-sectional view taken along the lines 4—4 of FIG. 5 showing the novel high speed cable hoist system of the multiple sheave linear speed enhancer mechanism of the novel high speed cable hoist system of the invention.
Figure 5:
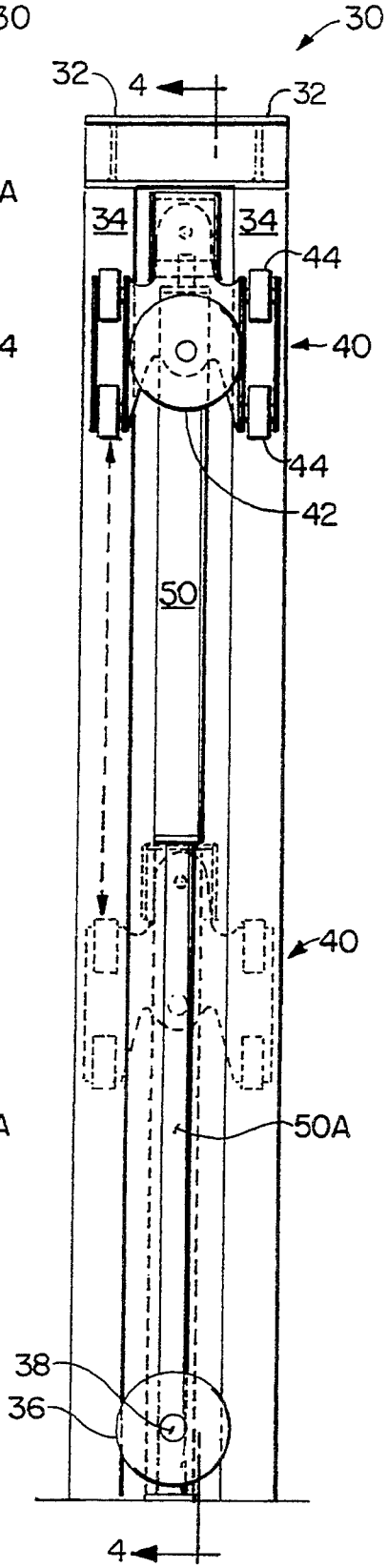
FIG. 5 is a vertical cross-sectional view taken along the lines 5—5 of FIG. 4.

Referring now to FIGS. 3–6 of the drawings, the specific features of hydraulically-driven multiple sheave mechanism 30 will be described in detail. Mechanism 30 can be seen to essentially consist of a frame formed from two spaced-part, horizontal I beams 32 at the top thereof with a corresponding pair of spaced-apart I beams 34 depending downwardly from the ends thereof to form the opposing sides of the frame. The I beams 32 and 34 forming the frame of hydraulically-driven multiple sheave mechanism 30 may be secured together in any conventional manner in order to form a rigid support for the remaining components of mechanism 30. As best seen in FIGS. 3–5, a stationary sheave set is positioned at the bottom of frame 30 and consists of eight sheaves 36 rotatably mounted on a suitable rigid central support pin 38. Although the high speed cable hoist system of the invention contemplates the use of varying number and size sheaves 36, applicant has discovered that mechanism 30 operates well with a total of eight sheaves 36 of 30 inch diameter.

Also shown in FIGS. 3–5 is vertically movable sheave head 40 which is constructed so as to support eight rotatably mounted sheaves 42 which correspond to the eight stationary sheaves 36 at the bottom of frame 30. Sheave head 40 is adapted to vertically travel along a portion of the vertical length of the spaced-apart pair of upstanding I beams 34 on each side of frame 30 by means of rotatably mounted rollers 44. The two pairs of rollers 44 on each side of sheave head 40 are configured so that each pair will address a respective one of spaced-apart I beams 34 and rotatably travel up and down the inside surface thereof (see particularly FIG. 5).

Figure 6:
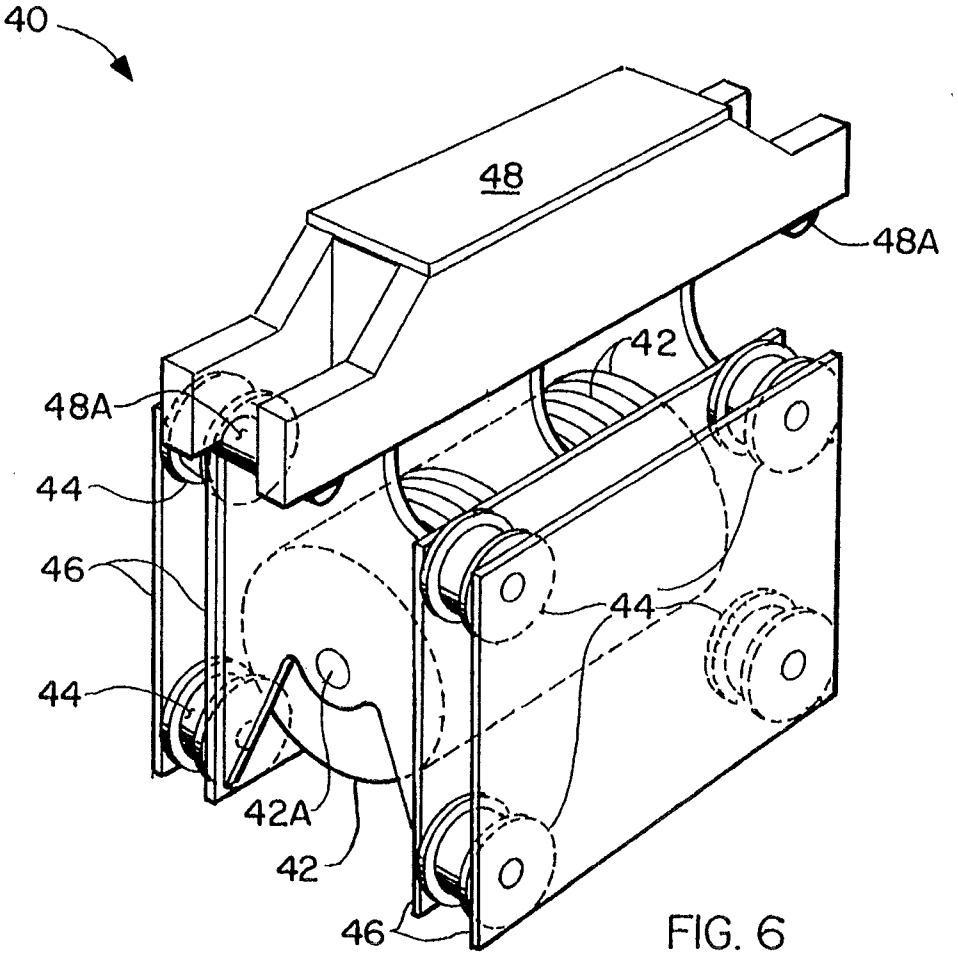
FIG. 6 is a perspective view of the vertically adjustable sheave head utilized in the novel high speed cable hoist system of the invention.

Although sheave head 40 can be formed in numerous different configurations and still be within the scope of the instant invention, FIG. 6 shows a preferred embodiment wherein sheave head 40 is constructed with eight 30 inch diameter sheaves 42 which are rotatably mounted on support pin 42A. The four pairs of rollers 44 are mounted to the frame of sheave head 40 by means of two spaced-apart support plates 46 provided on each side thereof (see FIG. 6). A crossbar 48 is mounted at the top of sheave head 40 and carries support pins 48A at each end thereof to which the bottom end of a respective hydraulic cylinder 50 is secured (see FIGS. 3–5). Thus, hydraulic cylinders 50 can be seen to be positioned between the pair of spaced-apart I beams 34 on each side of frame 30 and to extend downwardly to the base of frame 30 where the terminal end of the piston rod 50A is affixed to a stationary surface.

Although numerous types of hydraulic cylinders are contemplated to be utilized by the instant invention, applicant has discovered that a preferred cylinder arrangement is two 10 inch diameter by 12.50 foot stroke cylinders which are particularly suitable for vertically actuating sheave head 40 from its hoist cable retracted mode to its hoist cable extended mode (shown in phantom lines in FIGS. 4 and 5). Although not shown in the drawings, applicant utilizes a 150 to 200 horsepower squirrel cage motor to drive the hydraulic power unit for actuation of the two hydraulic cylinders 50, and preferably the squirrel cage motor and hydraulic power unit may be located adjacent to conventional DC driven hoist drums 12 on the crane gantry structure.

Although hoist cables 14 are not shown in FIGS. 4 and 5 for purposes of enhanced clarity of understanding of the structure depicted therein, FIG. 3 illustrates the method of wrapping hoist cables 14 around upper sheaves 42 and corresponding lower sheaves 36. Although other methods are possible, applicant prefers that each of the pair of hoist cables 14 (extending through pulleys 60 into hydraulically-drive multiple sheave mechanism 30) be vertically wrapped around two upper and lower sheaves 42 and 36, respectively. In this fashion, there is a desired multiplier effect when sheave head 40 moves either toward or away from stationary sheaves 36 positioned at the bottom of frame 30. For example, with reference to FIGS. 4 and 5, an upward movement of sheave head 30 from the phantom line position to the full line position would most preferably add about 50 to 100 feet per minute to the 100 feet per minute hoist speed of hoist drums 12 by, in effect, pulling on the dead ends of hoist cables 14 which are threaded through hydraulically-driven multiple sheave mechanism 30 and then securely terminated in any suitable fashion on or adjacent frame 30.

An optional feature of the present invention is a trim adjustment mechanism which is best shown in FIG. 3 and will now be described in detail. The trim adjustment mechanism provides for two hoist cables 14 to travel through pulleys 70 and be secured to a crossplate 72 or other suitable cable securement mechanism. Crossplates 72 positioned on opposing sides of frame 30 and to which two hoist cables 14 are secured are each operably connected to a hydraulic cylinder 74 which by pulling the cable ends outwardly from mechanism 30 or allowing them to be withdrawn therein, respectively, provides for selectively upwardly or downwardly adjusting the trim angle of one side of spreader S and the container carried thereby by raising or lowering, respectively, a corresponding headblock sheave 18 (see FIG. 2). To actuate trim cylinders 74 (most suitably hydraulic cylinders having a seven inch bore, 3 inch diameter piston rod, 24 inch stroke and a cylinder speed of about two inches per second), an additional 15 hp motor and pump are provided (not shown in the drawings).

Although not a requirement of the present invention, applicant contemplates that the preferred embodiment of the invention would utilize a suitable microprocessor in the control circuit in order to suitably synchronize the actuation of sheave head 40 motivating hydraulic cylinders 50 to actuation of conventional hoist drums 12 in order to optimize the lifting and lowering functionality of the high speed cable hoist system described herein. For example, while it would be possible to provide a sufficient stroke in hydraulic cylinders 50 to increase the hoist speed over the entire hoist range, it is most practical to limit the speed boost provided to hoist drums 12 by hydraulically-driven multiple sheave mechanism 30 over an area of hoist distance where it would be most useful. For example, mechanism 30 can be designed to take up 50 feet of cable per hoist cable (utilizing a total of four hoist cables 14) at a speed of 100 FPM, and the total distance the load will travel during this time would be 75 feet (using conventional calculations). This would be the minimum hoist distance covered at the enhanced hoist cable speed. Assuming cylinder speed is inversely proportional to the load on hoist cables 14 (and pressure in hydraulic cylinders 50), then a constant horsepower approach can be applied to the speed of hydraulic cylinders 50 so as to maintain the 75 foot speed boost distance for hoist cables 14 as the existing conventional DC control drive of hoist drums 12 is doing the same constant speed increase.

High speed is not needed in the upper 10 feet of hoist cable travel which is limited to slow hoist cable speed. When over a dock, hoist cables 14 would enter a slower speed when spreader S is approximately 20 feet above the dock. Thus, for a dockside container crane with a clear height over the dock of 100 feet, only 70 feet would be at the enhanced hoist cable speed over the dock.

The microprocessor could be programmed such that speed boosting hydraulic cylinders 50 would be fully extended when headblock sheaves 18 are about 10 feet from the upper stop. Further hoisting above this position will not move hydraulic cylinders 50. Once headblock sheaves 18 are lowered 10 feet from the upper stop, hydraulic cylinders 50 will retract in synchronization with hoist drums 12 and be fully retracted when headblock sheaves 18 are 75 feet below the upper slow down position. For deck container cargo, this will allow speed boosts at all hoist heights. When operating in a ship's hull, it is desirable to be able to shift the boost range (hydraulic cylinders 50 actuation range) to that distance required to clear a ship's hull structure. Thus, most suitably, the microprocessor would allow the operator to select by means of a switch in the operator cab a boost actuation from, for example, 45 feet above the dock to 30 feet below the dock.

An alternative to the speed boost described hereinabove by the position matching of hydraulic cylinders 50 and hoist drums 12, is an on demand speed boost. In this alternative, the hoist cable speed boost would be a function of operator demand as called for by throwing of a master switch and the speed of the hydraulic cylinders 50 would be fixed at one speed depending on the load being lifted (and the pressure applied to hydraulic cylinders 50). When the strokes of hydraulic cylinders 50 reach the extreme of travel, the boosted hoist cable speed is terminated and the operator continues that hoist direction at the normal speed. At any time the operator does not actuate the master switch, hydraulic cylinders 50 would not be actuated.

It should be appreciated that applicant contemplates that the instant invention may either be manually actuated by the operator in order to enhance hoist cable speed during the operation of hoist drums 12 during any predetermined period or be operated in accordance with a microprocessor circuit in order to achieve functions similar to those described in detail immediately hereinabove. Although the microprocessor circuitry is not specifically shown or described herein, applicant believes that one of ordinary skill in the art could develop and/or select suitable microprocessor circuitry to accomplish the desired hoisting performance parameters.

Furthermore, although FIGS. 1 and 2 depict two hoist cables 14 for clarity of explanation and FIGS. 3–6 depict a hydraulically-driven multiple sheave mechanism 30 adapted to accommodate four hoist cables 14, applicant contemplates that the instant invention can be suitably modified by one of ordinary skill in the art to retrofit conventional 4, 6 or 8 hoist cable dockside container handling cranes and still be within the intended scope of the present invention. Also, although applicant has depicted a pivotable boom dockside crane in FIGS. 1 and 2, applicant contemplates that the high speed hoist system of the invention can be utilized in other dock cranes including low profile cranes (commonly referred to as "shuttle boom cranes").

It will be understood that various details of the invention may be changed without departing from the scope of the invention. Furthermore, the foregoing description is for the purpose of illustration only, and not for the purpose of limitation—the invention being defined by the claims.

What is claimed is:

1. In a dockside container handling crane of the type comprising a crane frame and a movable boom extending generally laterally therefrom, said container crane further comprising a cable hoist system having a hoist drum with a plurality of cables wound therearound and operatively engaging a corresponding plurality of headblock sheaves adapted to be raised and lowered to vertically adjust a container-engaging spreader apparatus, the improvement comprising a hoist cable speed enhancing system positioned between said headblock sheaves and the terminal ends of said hoist cables, said hoist cable speed enhancing system comprising:

(a) a frame;

(b) a stationary sheave set supported by said frame and comprising a plurality of sheaves;

(c) a vertically adjustable sheave head supported by said frame and comprising a plurality of sheaves and being adapted for vertical movement within said frame toward and away from said stationary sheave set;

(d) means for selectively actuating said sheave head so as to motivate said sheave head toward or away from said stationary sheave set;

(e) each of said plurality of cables from said hoist drum extending between and wrapping around two or more sheaves in each of said sheave set and said sheave head, respectively, and terminating; and (f) a hydraulic cylinder positioned on each side of said frame and to each of which an equal number of said plurality of cables are fixedly connected at their termination, and actuation means for each of said hydraulic cylinders so that selective actuation will act to vertically adjust a corresponding side of said spreader apparatus supported by said headblock sheaves;

whereby the speed of extension or retraction of said plurality of cables by said hoist drum is increased by said actuating means by selectively motivating said second sheave head either toward or away, respectively, from said stationary first sheave head.

2. An improved dockside container handling crane according to claim 1 wherein said frame comprises a pair of spaced-apart horizontal I beams each having an I beam depending downwardly from each end thereof.

3. An improved dockside container handling crane according to claim 1 wherein said stationary sheave set comprises eight rotatably mounted sheaves.

4. An improved dockside container handling crane according to claim 1 wherein said sheave head comprises a plurality of rollers on each opposing side thereof for vertical movement within said frame and eight rotatably mounted sheaves.

5. An improved dockside container handling crane according to claim 1 wherein said means for selectively actuating said sheave head comprises a pair of spaced-apart hydraulic cylinders each being operatively connected at one end to said sheave head and fixedly secured at the other end adjacent said stationary sheave set whereby said sheave head can be selectively urged toward and away from said stationary sheave set by said actuating means.

6. An improved dockside container handling crane according to claim 1 wherein said plurality of cables from said hoist drum comprises four cables.

7. An improved dockside container handling crane according to claim 6 wherein each of said four cables is wrapped around two sheaves in each of said stationary sheave set and said sheave head, respectively.

* * * * *